US010210808B2

(12) United States Patent
Jung et al.

(10) Patent No.: US 10,210,808 B2
(45) Date of Patent: Feb. 19, 2019

(54) LUMINANCE CONTROLLER AND ORGANIC LIGHT EMITTING DISPLAY DEVICE HAVING THE SAME

(71) Applicant: Samsung Display Co., Ltd., Yongin-si, Gyeonggi-Do (KR)

(72) Inventors: Yeon-Shil Jung, Cheonan-si (KR); Young-Seob Kim, Cheonan-si (KR); Ji-Yun Son, Seongnam-si (KR); Eun-Jung Oh, Asan-si (KR); Deok-Jun Choi, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 18 days.

(21) Appl. No.: 15/389,916

(22) Filed: Dec. 23, 2016

(65) Prior Publication Data

US 2017/0186375 A1 Jun. 29, 2017

(30) Foreign Application Priority Data

Dec. 29, 2015 (KR) ..... 10-2015-0188326

(51) Int. Cl.
*G09G 3/3258* (2016.01)

(52) U.S. Cl.
CPC ... *G09G 3/3258* (2013.01); *G09G 2320/0626* (2013.01)

(58) Field of Classification Search
CPC ..... G09G 3/3258; G09G 2320/0626; G09G 2320/0276; G09G 2320/0673
See application file for complete search history.

(56) References Cited

U.S. PATENT DOCUMENTS

2007/0146253 A1* 6/2007 Tang ..... G09G 3/3208 345/77
2011/0115830 A1* 5/2011 Lee ..... G09G 3/3233 345/690
2014/0118228 A1* 5/2014 Kang ..... G09G 3/3233 345/77
2014/0118409 A1* 5/2014 Jun ..... G09G 5/02 345/690

(Continued)

FOREIGN PATENT DOCUMENTS

KR 10-2008-0090923 A 10/2008
KR 10-0884791 2/2009

*Primary Examiner* — Yuzhen Shen
(74) *Attorney, Agent, or Firm* — Innovation Counsel LLP

(57) ABSTRACT

A luminance controller according to example embodiments includes a gamma set selector to select a reference gamma set from among first through N-th gamma sets respectively corresponding to first through N-th reference luminances, based on a target luminance of a display panel; an initialization voltage selector to select an initialization voltage corresponding to the reference gamma set, from among first through N-th initialization voltage offsets respectively corresponding to the first through N-th gamma sets; a common voltage selector to select a common voltage corresponding to the reference gamma set from among first through N-th common voltage offsets respectively corresponding to the first through N-th gamma sets; and a determiner to determine a target initialization voltage based on the target luminance and the initialization voltage, and to determine a target common voltage based on the target luminance and the common voltage.

19 Claims, 8 Drawing Sheets

(56) References Cited

U.S. PATENT DOCUMENTS

2014/0239270 A1* 8/2014 Ko ..... H01L 27/1255
257/40
2014/0292622 A1* 10/2014 Lee ..... G09G 3/3233
345/80

* cited by examiner

FIG. 5

DBL

| DISPLAY LUMINANCE LEVEL | REFERENCE LEVEL | GAMMA REGISTER SET | ELVSS_OFFSET | VINT_OFFSET |
|---|---|---|---|---|
| LEVEL7 | DBV7[7:0] | GAMMA SET7 | ELVSS_OFFSET7 | VINT_OFFSET7 |
| LEVEL6 | DBV6[7:0] | GAMMA SET6 | ELVSS_OFFSET6 | VINT_OFFSET6 |
| LEVEL5 | DBV5[7:0] | GAMMA SET5 | ELVSS_OFFSET5 | VINT_OFFSET5 |
| LEVEL4 | DBV4[7:0] | GAMMA SET4 | ELVSS_OFFSET4 | VINT_OFFSET4 |
| LEVEL3 | DBV3[7:0] | GAMMA SET3 | ELVSS_OFFSET3 | VINT_OFFSET3 |
| LEVEL2 | DBV2[7:0] | GAMMA SET2 | ELVSS_OFFSET2 | VINT_OFFSET2 |
| LEVEL1 | DBV1[7:0] | GAMMA SET1 | ELVSS_OFFSET1 | VINT_OFFSET1 |

LUMINANCE CONTROLLER AND ORGANIC LIGHT EMITTING DISPLAY DEVICE HAVING THE SAME

CROSS REFERENCE TO RELATED APPLICATION

This application claims priority to, and the benefit of, Korean Patent Application No. 10-2015-0188326 filed on Dec. 29, 2015 in the Korean Intellectual Property Office (KIPO), the disclosure of which is hereby incorporated by reference herein in its entirety.

BACKGROUND

1. Field

Example embodiments of the inventive concept relate generally to display devices. More particularly, example embodiments of the inventive concept relate to luminance controllers and organic light emitting display devices having the same.

2. Discussion of Related Art

A black current bypass (BCB) driving method initializes an organic light emitting diode by providing an initialization voltage (e.g., VINT voltage) to an anode of the organic light emitting diode. BCB driving is used to drive a pixel to improve black luminance performance (or black image performance). However, in using this method, light emission is often delayed in a low luminance (and/or a low grayscale) range by parasitic elements of the organic light emitting diode such as a parasitic capacitance, etc. In addition, a color shift occurs due to differences of luminance efficiency of red/green/blue pixels.

SUMMARY

Example embodiments provide a luminance controller controlling an initialization voltage and a common voltage provided to a pixel, based on luminance change, to improve a light emission delay.

Example embodiments provide an organic light emitting display device including the luminance controller.

According to example embodiments, a luminance controller may comprise a gamma set selector configured to select a reference gamma set from among a first gamma set through an N-th gamma set respectively corresponding to first reference luminance through an N-th reference luminance based on a target luminance of a display panel, the first through N-th reference luminances being set in ascending order of luminance, an initialization voltage selector configured to select an initialization voltage corresponding to the reference gamma set, the initialization voltage being selected from among first through N-th initialization voltage offsets respectively corresponding to the first through N-th gamma sets, a common voltage selector configured to select a common voltage corresponding to the reference gamma set, the common voltage being selected from among first through N-th common voltage offsets respectively corresponding to the first through N-th gamma sets, and a determiner configured to determine a target initialization voltage provided to the display panel, the target initialization voltage determined based on the target luminance and the initialization voltage, and to determine a target common voltage provided to the display panel, the target initialization voltage determined based on the target luminance and the common voltage, where N is an integer greater than 1.

In example embodiments, the target initialization voltage may correspond to an anode initialization voltage of an organic light emitting diode in the display panel.

In example embodiments, the target common voltage may correspond to a voltage to be applied to a cathode of the organic light emitting diode.

In example embodiments, the first initialization voltage offset may correspond to a highest voltage from among the first through N-th initialization voltage offsets, and the N-th initialization voltage offset may correspond to a lowest voltage from among the first through N-th initialization voltage offsets.

In example embodiments, the first common voltage offset may correspond to a highest voltage among the first through N-th common voltage offsets, and the N-th common voltage offset may correspond to a lowest voltage among the first through N-th common voltage offsets.

In example embodiments, the initialization voltage selector may select a K-th initialization voltage offset as the initialization voltage when the gamma set selector selects a K-th gamma set as the reference gamma set. The common voltage selector may select a K-th common voltage offset as the common voltage when the gamma set selector selects the K-th gamma set as the reference gamma set.

In example embodiments, the determiner may determine the initialization voltage as the target initialization voltage and may determine the common voltage as the target common voltage, when the target luminance corresponds to a K-th reference luminance.

In example embodiments, the initialization voltage selector may select a J-th initialization voltage offset and a (J-1)-th initialization voltage offset to provide to the determiner when the target luminance is between a (J-1)-th reference luminance and a J-th reference luminance. The common voltage selector may select a J-th common voltage offset and a (J-1)-th common voltage offset to provide to the determiner when the target luminance is between the (J-1)-th reference luminance and the J-th reference luminance.

In example embodiments, the determiner may comprise a first interpolator configured to perform an interpolation between the J-th initialization voltage offset and the (J-1)-th initialization voltage offset to determine the target initialization voltage, and a second interpolator configured to perform an interpolation between the J-th common voltage offset and the (J-1)-th common voltage offset to determine the target common voltage.

In example embodiments, the gamma set selector may comprise a register configured to store a plurality of register values respectively corresponding to the first through N-th gamma sets.

According to example embodiments, an organic light emitting display device may comprise a display panel including a plurality of pixels each having an organic light emitting diode, a luminance controller configured to select a reference gamma set based on target luminance of the display panel, and to determine a target initialization voltage and a target common voltage based on the target luminance and the reference gamma set, a gamma voltage generator configured to determine a target gamma set by comparing reference luminance corresponding to the reference gamma set with the target luminance, and to generate a plurality of gamma voltages having voltage values within the target gamma set, a display panel driver configured to drive the display panel based on the gamma voltages, and a power supply configured to provide the target initialization voltage, the target common voltage, and a driving voltage to the display panel based on a control of the luminance controller.

In example embodiments, the luminance controller may comprise a gamma set selector configured to select the reference gamma set from among a first gamma set through an N-th gamma set respectively corresponding to a first reference luminance through an N-th reference luminance based on the target luminance, the first through N-th reference luminances being respectively in ascending order of luminance, an initialization voltage selector configured to select an initialization voltage corresponding to the reference gamma set, from among a first through an N-th initialization voltage offset respectively corresponding to the first through N-th gamma sets, a common voltage selector configured to select a common voltage corresponding to the reference gamma set, from among a first through an N-th common voltage offset respectively corresponding to the first through N-th gamma sets, and a determiner configured to determine the target initialization voltage based on the target luminance and the initialization voltage, and to determine the target common voltage based on the target luminance and the common voltage, where N is an integer greater than 1.

In example embodiments, the target initialization voltage may correspond to an anode initialization voltage of the organic light emitting diode.

In example embodiments, the target common voltage may correspond to a voltage to be applied to a cathode of the organic light emitting diode.

In example embodiments, the first initialization voltage offset may correspond to a highest voltage, from among the first through N-th initialization voltage offsets, and the N-th initialization voltage offset may correspond to a lowest voltage from among the first through N-th initialization voltage offsets.

In example embodiments, the first common voltage offset may correspond to a highest voltage from among the first through N-th common voltage offsets, and the N-th common voltage offset may correspond to a lowest voltage from among the first through N-th common voltage offsets.

In example embodiments, the initialization voltage selector may select a K-th initialization voltage offset as the initialization voltage when the gamma set selector selects a K-th gamma set as the reference gamma set. The common voltage selector may select a K-th common voltage offset as the common voltage when the gamma set selector selects the K-th gamma set as the reference gamma set.

In example embodiments, the gamma voltage generator may perform an interpolation between a J-th gamma set and a (J-1)-th gamma set when the target luminance is between a (J-1)-th reference luminance and a J-th reference luminance.

In example embodiments, the determiner may comprise a first interpolator configured to perform an interpolation between the J-th initialization voltage offset and the (J-1)-th initialization voltage offset to determine the target initialization voltage when the initialization voltage selector selects a J-th initialization voltage offset and a (J-1)-th initialization voltage offset, and a second interpolator configured to perform an interpolation between the J-th common voltage offset and the (J-1)-th common voltage offset to determine the target common voltage when the initialization voltage selector selects the J-th initialization voltage offset and the (J-1)-th initialization voltage offset.

In example embodiments, the display panel driver may comprise a scan driver configured to provide a scan signal to the display panel; an emission driver configured to provide an emission control signal to the display panel; a data driver configured to provide a data voltage to the display panel, the data voltage generated based on the gamma voltages; and a controller configured to control the scan driver, the emission driver, and the data driver.

Therefore, the luminance controller according to example embodiments may control the target initialization voltage and the target common voltage, that correspond to the selected gamma set, based on change in the target luminance. Thus, a voltage difference between the target initialization voltage and the target common voltage may be reduced or minimized when a black current bypass (BCB) operation of the pixel is performed, so that a light emission delay caused by the BCB operation may be reduced or minimized. Particularly, a voltage for the BCB operation may be moved closer to a threshold voltage of the organic light emitting diode when a low driving current display such as a low luminance display and/or a low grayscale display is performed, so that the light emission delay may be reduced.

In addition, the organic light emitting display device may include a luminance controller such that the light emission delay may be improved without a change of optical characteristics. Further, a color shift may be eliminated or reduced in the low luminance (low gray scale) range.

BRIEF DESCRIPTION OF THE DRAWINGS

Example embodiments can be understood in more detail from the following description taken in conjunction with the accompanying drawings, in which:

FIG. 5 is a diagram illustrating an example in which a gamma set, an initialization voltage offset, and a common voltage offset are set in the luminance controller of FIG. 4.

DETAILED DESCRIPTION OF EMBODIMENTS

Exemplary embodiments will be described more fully hereinafter with reference to the accompanying drawings, in which various embodiments are shown. The drawings may not be to scale. All numerical values are approximate, and may vary. All examples of specific materials and compositions are to be taken as nonlimiting and exemplary only. Other suitable materials and compositions may be used instead.

Figure 1:
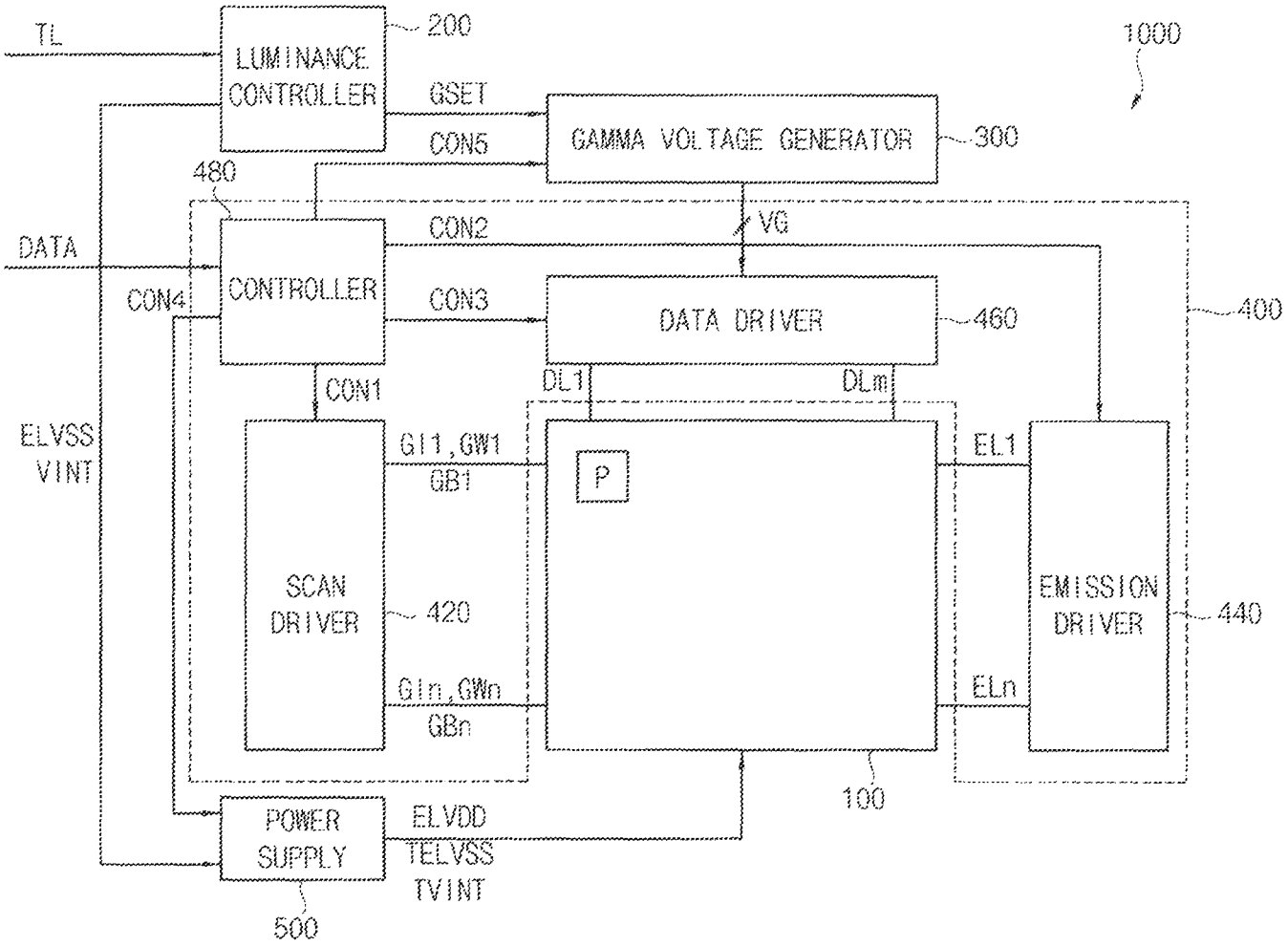
FIG. 1 is a block diagram of an organic light emitting display device constructed according to example embodiments.

FIG. 1 is a block diagram of an organic light emitting display device constructed according to example embodiments.

Referring to FIG. 1, the organic light emitting display device 1000 may include a display panel 100, a luminance controller 200, a gamma voltage generator 300, a display panel driver 400, and a power supply 500. In one embodiment, the display panel driver 400 may include a scan driver 420, an emission driver 440, a data driver 460, and a controller 480.

The display panel 100 may include a plurality of pixels P, and may display images. The display panel 100 may be connected to the scan driver 420 via a plurality of scan lines. The display panel 100 may be connected to the emission driver 440 via a plurality of emission lines EL1 through ELn. The display panel 100 may be connected to the data driver 460 via a plurality of data lines DL1 through DLm. The display panel 100 may include M (M is a positive integer) pixel columns each connected to the respective data lines DL1 through DLm, and N (N is a positive integer) pixel rows each connected to the respective scan lines and the emission lines EL1 through ELn. Thus, the pixels P can be arranged in a matrix arrangement and the display panel 100 can include N*M pixels. In some embodiments, each of the pixels P may include an organic light emitting diode. The organic light emitting diode may emit light having a certain luminance level corresponding to a data voltage applied from the data driver 460, in response to an emission control signal from the emission control lines EL1 through ELn. In one embodiment, each of the pixels P may receive scan signals GW1 through GWn, initialization signals GI1 though GIn, and bypass signals GB1 through GBn from the scan driver 420. The initialization signals GI1 though GIn may correspond to previous ones of present scan signals GW1 through GWn. The bypass signals GB1 through GBn may correspond to following scan signals of present scan signals GW1 through GWn. The initialization signals GI1 through Gin may be used to initialize a gate voltage of driving transistors in the pixels P. The bypass signals GB1 through GBn may be used to initialize an anode voltage of the organic light emitting diodes in the pixels P, to prevent an increase of black luminance.

A pixel structure in the display panel 10 will be described in detail with reference to FIG. 2.

The luminance controller 200 may control luminance of the image displayed on the display panel 100 using luminance dimming. The luminance controller 200 may select a reference gamma set GSET based on a target luminance TL of the display panel 100, and may determine a target initialization voltage TVINT and a target common voltage TELVSS based on the reference gamma set GSET. In one embodiment, the luminance controller 200 may comprise a gamma set selector including a plurality of gamma sets respectively corresponding to a plurality of reference luminances, an initialization voltage selector including a plurality of initialization voltage offsets respectively corresponding to the gamma sets (and the reference luminances), a common voltage selector including a plurality of common voltage offsets respectively corresponding to the gamma sets (and the reference luminances), and a determiner to determine the target initialization voltage TVINT and the target common voltage TELVSS that correspond to the target luminance TL. In one embodiment, the luminance controller 200 may be physically included in the controller 480 or the power supply 500.

The luminance controller 200 may further include at least one register to store a plurality of register values respectively corresponding to the gamma sets. Similarly, the luminance controller 200 may further include at least one register to store the initialization voltage offsets and the common voltage offsets respectively corresponding to the gamma sets. The target initialization voltage TVINT may correspond to a voltage to initialize the anode voltage of the organic light emitting diode. The target common voltage TELVSS may correspond to a voltage to be applied to a cathode of the organic light emitting diode.

The luminance controller 200 may select one of the gamma sets and at the same time select one of the initialization voltage offsets and one of the common voltage offsets that correspond to the selected gamma set. Thus, the target initialization voltage TVINT and the target common voltage TELVSS may be adjusted to a set value.

The gamma set selector may select the reference gamma set GSET based on the target luminance TL. The initialization voltage selector may select an initialization voltage corresponding to the reference gamma set GSET based on the target luminance TL. The common voltage selector may also select a common voltage corresponding to the reference gamma set GSET based on the target luminance TL. The determiner may compare the target luminance and the selected reference luminance, and interpolate the adjacent voltage offsets so as to determine the target initialization voltage TVINT and the target common voltage TELVSS. The luminance controller 200 will be described in detail with reference to FIGS. 4 through 7C.

The gamma voltage generator 300 may determine a target gamma set by comparing a reference luminance corresponding to the reference gamma set GSET with the target luminance TL, and subsequently-generated gamma voltages VG may lie within the target gamma set. The number of the gamma voltages VG may depend on the number of grayscale levels implemented in the organic light emitting display device 1000. In one embodiment, the organic light emitting display device 1000 may be implemented with 256 grayscale levels, such that the number of the gamma voltages VG may be 256. The gamma voltage generator 300 may perform luminance control or dimming by adjusting the gamma voltages VG based on the target gamma set.

The display panel driver 400 may drive the display panel 100 based on input image data DATA and gamma voltages VG In one embodiment, the display panel driver 400 may include the scan driver 420, the emission driver 400, the data driver 460, and the controller 480.

The scan driver 420 may provide scan signals GW1 through GWn to the display panel 100 via the plurality of scan lines. In one embodiment, the scan driver 420 may provide the scan signals GW1 through GWn, the initialization signals GI1 through GIn, and the bypass signals GB1 through GBn. In one embodiment, each of the scan lines may be connected to pixels P arranged in one of the pixel rows.

The emission driver 440 may provide the emission signals to the display panel 100 via the plurality of emission lines EL1 through ELn. In some embodiments, each of the emission lines EL1 through ELn may be connected to pixels P arranged in one of the pixel rows.

The data driver 460 may provide data voltages, which are generated based on selected gamma voltages VG to the display panel 100 via the plurality of data lines DL1 through DLm. Each of the data lines DL1 through DLm may be connected to pixels P arranged in one of the pixel columns.

The controller 480 may control the scan driver 420, the emission driver 440, the data driver 460, the power supply 500, and the gamma voltage generator 300 based on first through fifth control signals CON1 through CONS. In some embodiments, the controller 480 may receive an input control signal and input image data DATA from an image source, e.g., an external graphic apparatus.

The power supply 500 may provide the target initialization voltage TVINT, the target common voltage TELVSS, and a driving voltage ELVDD to the display panel 100 according to control signals from the luminance controller 200. In one embodiment, the power supply may be included in the luminance controller 200.

As described above, the organic light emitting display device 100 may include the luminance controller 200 to select one of the gamma sets corresponding to the reference luminance, and at the same time to select one of the initialization voltage offsets and one of the common voltage offsets that correspond to the selected gamma set. Thus, a voltage difference between the target initialization voltage TVINT and the target common voltage TELVSS may be reduced or minimized when a black current bypass (BCB) operation is performed, so that a light emission delay caused by the BCB operation may be reduced or minimized. Particularly, a voltage for the BCB operation may be moved closer to a threshold voltage of the organic light emitting diode when low driving current display such as low luminance display and/or low grayscale display is performed, so that light emission delay may be reduced. Thus, a color shift may be eliminated or reduced in the low luminance (low grayscale) range.

Figure 2:
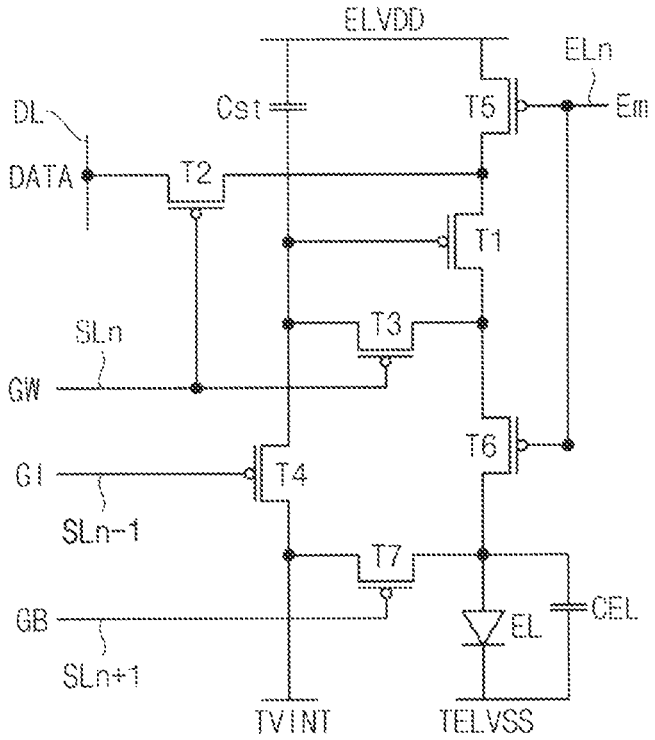
FIG. 2 is a circuit diagram illustrating an example of a pixel included in the organic light emitting display device of FIG. 1.

FIG. 2 is a circuit diagram illustrating an example of a pixel included in the organic light emitting display device of FIG. 1.

Referring to FIG. 2, the pixel may include a switching transistor T2 connected to a data line DL and having a gate electrode configured to receive a scan signal GW, a driving transistor T1 connected to the switching transistor T2, a compensation transistor T3 connected to the driving transistor T1 and having a gate electrode configured to receive the scan signal GW, an initialization transistor T4 connected to a gate electrode of the driving transistor T1 and having a gate electrode configured to receive an initialization signal GI, emission control transistors T5 and T6 (or an operation control transistor T5) connected to the driving transistor T1 and having gate electrodes configured to receive an emission control signal Em, an organic light emitting diode EL connected to the emission control transistors T5 and T6, a bypass transistor T7 connected to the organic light emitting diode EL and having a gate electrode configured to receive a bypass signal GB, and a storage capacitor Cst connected between the gate electrode of the driving transistor T1 and a driving voltage ELVDD.

The driving transistor T1 may include a gate electrode connected to a first electrode of the storage capacitor Cst, a source electrode connected to the driving voltage line (i.e. ELVDD supply) via the operation control transistor T5, and a drain electrode electrically connected to the anode of the organic light emitting diode EL via the emission control transistor T6. The driving transistor T1 may receive a data signal DATA according to a switching operation of the switching transistor T2, and may supply a driving current to the organic light emitting diode EL.

The switching transistor T2 may include a gate electrode connected to the scan line SL, a source electrode connected to the data line DL, and a drain electrode connected to the source electrode of the driving transistor T1. The switching transistor T2 may be turned on according to the scan signal GW received through the scan line SLn, and may transmit the data signal DATA from the data line DL to the source electrode of the driving transistor T1.

The compensation transistor T3 may include a gate electrode connected to the scan line SLn, a source electrode connected to the drain electrode of the driving transistor T1, and a drain electrode connected to the first electrode of the storage capacitor Cst, which is also connected to a drain electrode of the initialization transistor T4 and the gate electrode of the driving transistor T1. The compensation transistor T3 may be turned on according to the scan signal GW to diode-connect the driving transistor T1, such that a threshold voltage of the driving transistor T1 may be compensated.

The initialization transistor T4 may include a gate electrode connected to the initialization line SLn−1 (e.g., a previous scan line), a source electrode electrically connected to a target initialization voltage TVINT, and a drain electrode connected to the drain electrode of the compensation transistor T3 and connected to the gate electrode of the driving transistor T1. The initialization transistor T4 may be turned on according to the initialization signal GI to transmit the target initialization voltage TVINT to the gate electrode of the driving transistor T1, so that the gate voltage of the driving transistor T1 may be initialized. Here, the target initialization voltage TVINT may be determined by the luminance controller 200 based on a target luminance. The target initialization voltage TVINT may be a global voltage provided to a plurality of pixels at substantially the same time. The initialization signals GI may correspond to a previous scan signal.

The operation control transistor T5 may include a gate electrode connected to the emission control line ELn, a source electrode electrically connected to the driving voltage ELVDD, and a drain electrode connected to the source electrode of the driving transistor T1. The operation control transistor T5 may control the electrical connection between the source electrode of the driving transistor T1 and the driving voltage ELVDD based on the emission control signal Em.

The emission control transistor T6 may include a gate electrode connected to the emission control line ELn, a source electrode connected to the drain electrode of the driving transistor T1 and connected to the source electrode of the compensation transistor T3, and a drain electrode connected to the anode of the organic light emitting diode EL. The operation control transistor T5 and the emission control transistor T6 may be concurrently turned on according to the emission control signal Em, such that a driving current may flow into the organic light emitting diode EL.

The bypass transistor T7 may include a gate electrode connected to a bypass control line SLn+1 (e.g., a following scan line), a source electrode connected to the drain electrode of the emission control transistor T6 and connected to the anode of the organic light emitting diode EL, and a drain electrode electrically connected to the target initialization voltage TVINT. The target initialization voltage TVINT may be adjusted according to luminance. The bypass transistor T7 may be turned on according to a bypass control signal GB, to transmit the target initialization voltage TVINT to the anode of the organic light emitting diode EL, and so that the organic light emitting diode EL may be initialized. The bypass transistor T7 may be used to more clearly display a black image or black luminance. The BCB operation may result in the bypass transistor T7 being turned on to initialize the organic light emitting diode EL.

The anode of the organic light emitting diode EL may be connected to the drain electrode of the emission control transistor T6 and the source electrode of the bypass transistor T7, and a cathode of the organic light emitting diode EL may be electrically connected to a target common voltage TELVSS. As above, the target common voltage TELVSS may be determined by the luminance controller 200 based on the target luminance. Namely, the target common voltage TELVSS may be adjusted according to luminance. The organic light emitting diode EL may further include a parasitic capacitor CEL.

A light emission delay may increase as a voltage charging time of the parasitic capacitor CEL increases. Particularly, the voltage charging time of the parasitic capacitor CEL after the BCB operation may be increased when a low driving current display such as a low luminance display and/or a low grayscale display is performed, so that the light emission delay may be increased. The light emission delay may be represented by Expression 1.

$$Td=\{Cel*(VINT+Vth-ELVSS)\}/Id \quad \text{[Expression 1]}$$

In expression, Td indicates the light emission delay, Cel indicates a capacitance of the parasitic capacitor CEL, VINT indicates an initialization voltage provided to the anode of the organic light emitting diode EL, Tth indicates a threshold voltage of the organic light emitting diode EL, ELVSS indicates a common voltage provided to the cathode of the organic light emitting diode EL, and Id indicates an emission current. Here, as the emission current Id decreases (i.e., when the low luminance display and/or the low grayscale display is performed), the light emission delay may increase. To solve this problem, the initialization voltage and the common voltage may be controlled according to the luminance. For example, when the luminance increases, the luminance controller 200 may reduce the initialization voltage and the common voltage. In one embodiment, an initialization voltage offset and a common voltage offset corresponding to a selected gamma set may be selected, and the target initialization voltage TVINT and the target common voltage TELVSS may be determined based on the initialization voltage offset and the common voltage offset.

Figure 3:
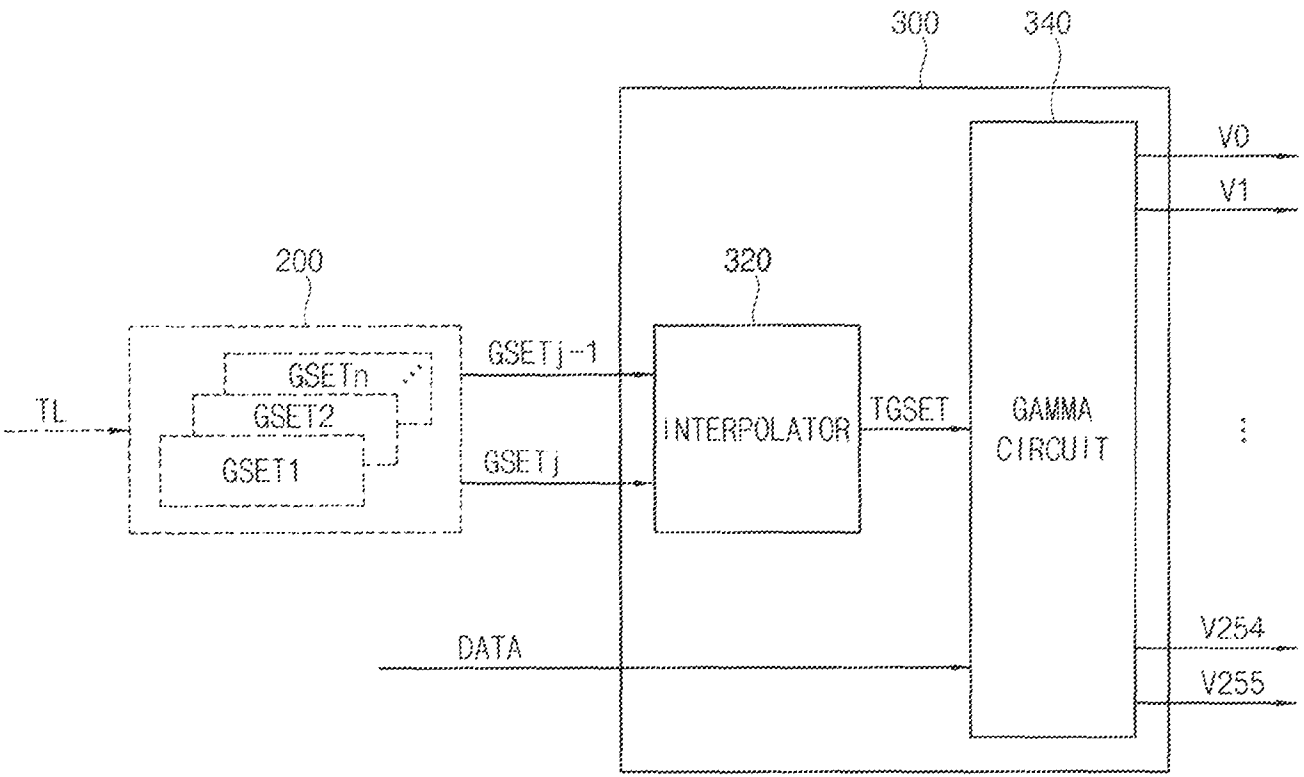
FIG. 3 is a block diagram illustrating an example of a gamma voltage generator included in the organic light emitting display device of FIG. 1.

FIG. 3 is a block diagram illustrating an example of a gamma voltage generator included in the organic light emitting display device of FIG. 1.

Referring to FIG. 3, the gamma voltage generator 300 may include an interpolator 320 and a gamma circuit 340.

The gamma voltage generator 300 may determine a target gamma set TGSET by comparing a reference luminance corresponding to a reference gamma set GSETj with the target luminance TL, and may generate a plurality of gamma voltages V0 through V255 that lie within the target gamma set TGSET. The reference gamma set GSETj may be a gamma set that is selected from among a plurality of gamma sets GSET1 through GSETn based on the target luminance TL.

The reference gamma set GSETj may be selected by the luminance controller 200. The first through N-th gamma sets GSET1 through GSETn may correspond to first through N-th reference luminances, respectively. For example, the first reference luminance may correspond to about 100 nit, and the first gamma set GSET1 may include a register value corresponding to gamma voltages for implementing the 100 nit luminance (i.e., the first reference luminance). In addition, the N-th reference luminance may correspond to a maximum luminance of the organic light emitting display device (e.g., about 300 nit), and the N-th gamma set GSETn may include a register value corresponding to gamma voltages for implementing the maximum luminance (i.e., the N-th reference luminance).

In one embodiment, the luminance controller 200 may select a K-th gamma set to be the reference gamma set when the target luminance TL corresponds to a K-th reference luminance, where K is an integer less than or equal to N and greater than 0. The gamma voltage generator 300 may receive the reference gamma set, or the register value corresponding to the reference gamma set, from the luminance controller 200. The gamma voltage generator 300 may determine the target gamma set TGSET corresponding to the reference gamma set, and may generate the plurality of gamma voltages V0 through V255 based on the target gamma set TGSET.

The interpolator 320 may linearly (or otherwise) interpolate adjacent gamma sets GSETj-1 and GSETj to determine the target gamma set TGSET corresponding to the target luminance TL. In one embodiment, when the target luminance is between a (J-1)-th reference luminance and a J-th reference luminance, the luminance controller 200 may provide a J-th gamma set GSETj and a (J-1)-th gamma set GSETj to the interpolator 320. In one embodiment, the interpolator 320 may receive register values corresponding to the J-th gamma set GSETj and the (J-1)-th gamma set GSETj from the luminance controller 200. The interpolator may linearly interpolate between the J-th gamma set GSETj and the (J-1)-th gamma set GSETj based on the target luminance TL, to determine the target gamma set TGSET corresponding to the target luminance TL.

The gamma circuit 340 may generate the gamma voltages V0 through V255 based on image data DATA from an external graphic source or the controller 480, and the target gamma set TGSET. The gamma circuit 340 may include a plurality of selectors (or multiplexers) and a plurality of resistor strings to output the gamma voltages V0 through V255. The gamma voltages V0 through V255 may be provided to the data driver 460.

Figure 4:
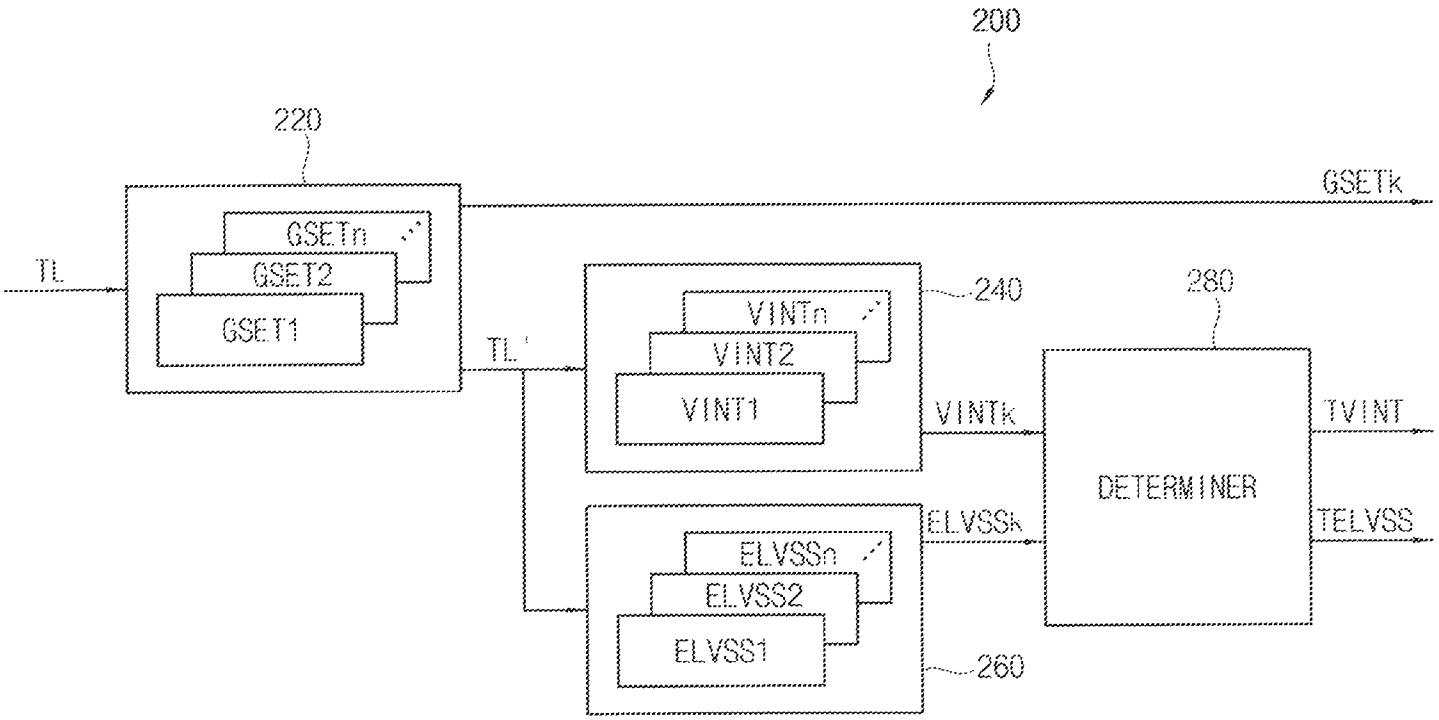
FIG. 4 is a block diagram of a luminance controller constructed according to example embodiments.

FIG. 4 is a block diagram of a luminance controller constructed according to example embodiments.

Referring to FIG. 4, the luminance controller 200 may include a gamma set selector 220, an initialization voltage selector 240, a common voltage selector 260, and a determiner 280.

The luminance controller 200 may determine a reference gamma set GSETk, a target initialization voltage TVINT, and a target common voltage TELVSS based on a target luminance TL.

The gamma set selector 220 may include first through N-th gamma sets GSET1 through GSETn respectively corresponding to first through N-th reference luminances based on the target luminance TL of a display panel. For example, the first reference luminance may correspond to about 100 nit and the N-th reference luminance may correspond to a maximum luminance of the organic light emitting display device (e.g., about 300 nit). In one embodiment, the gamma set selector 220 may include a register to store a plurality of register values respectively corresponding to the first through N-th gamma sets GSET1 through GSETn.

The gamma set selector 220 may receive the target luminance TL from an external graphic source. The gamma set selector 220 may select the reference gamma set from among the first through N-th gamma sets GSET1 through GSETn, based on the target luminance TL. For example, the gamma set selector 220 may select a K-th gamma set corresponding to a K-th reference luminance, as the reference gamma set when the target luminance TL corresponds to the K-th reference luminance. The reference gamma set may be provided to a gamma voltage generator of an organic light emitting display device. The gamma set selector 220 may select a J-th gamma set GSETj corresponding to a J-th reference luminance, and a (J-1)-th gamma set GSETj-1 corresponding to a (J-1)-th reference luminance, when the target luminance TL is between the (J-1)-th reference luminance and the J-th reference luminance. In one embodiment, the gamma set selector 220 may provide information identifying the reference gamma set or the selected gamma sets to the initialization voltage selector 240 and the common voltage selector 260.

The initialization voltage selector 240 may include first through N-th initialization voltage offsets VINT1 through VINTn respectively corresponding to the first through N-th gamma sets GSET1 through GSETn. The first through N-th initialization voltage offsets VINT1 through VINTn may also respectively correspond to the first through N-th reference luminances. The target initialization voltage TVINT may be controlled based on the first through N-th initialization voltage offsets VINT1 through VINTn. In one embodiment, the first initialization voltage offset VINT1 may correspond to a highest voltage from among the first through N-th initialization voltage offsets VINT1 through VINTn, and the N-th initialization voltage offset VINTn may correspond to a lowest voltage from among the first through N-th initialization voltage offsets VINT1 through VINTn.

In one embodiment, the initialization voltage selector 240 may directly receive the target luminance TL, and may select an initialization voltage offset VINTk, corresponding to the reference gamma set GSETk, from among the first through N-th initialization voltage offsets VINT1 through VINTn, based on the target luminance TL. The selected initialization voltage offset VINTk and the reference gamma set GSETk may be selected at the same time. In one embodiment, the initialization voltage selector 240 may receive information identifying the reference gamma set GSETk from the gamma set selector 220, and may select the selected initialization voltage offset VINTk corresponding to the reference gamma set GSETk.

The initialization voltage selector 240 may select a K-th initialization voltage offset VINTk as the initialization voltage, when the target luminance TL corresponds to the K-th reference luminance. The K-th initialization voltage offset VINTk may correspond to the K-th reference luminance and the K-th gamma set GSETk. The selected initialization voltage offset VINTk may be provided to the determiner 280.

The initialization voltage selector 240 may select a J-th initialization voltage offset VINTj corresponding to the J-th reference luminance, and a (J-1)-th initialization voltage offset VINTj-1 corresponding to the (J-1)-th reference luminance, when the target luminance TL is between the (J-1)-th reference luminance and the J-th reference luminance. The J-th initialization voltage offset VINTj and the (J-1)-th initialization voltage offset VINTj-1 may be provided to the determiner 280.

The common voltage selector 260 may include first through N-th common voltage offsets ELVSS1 through ELVSSn respectively corresponding to the first through N-th gamma sets GSET1 through GSETn. The first through N-th common voltage offsets ELVSS1 through ELVSSn may also respectively correspond to the first through N-th reference luminances. The target common voltage TELVSS may be determined based on the first through N-th common voltage offsets ELVSS1 through ELVSSn. In one embodiment, the first common voltage offset ELVSS1 may correspond to a highest voltage from among the first through N-th common voltage offsets ELVSS1 through ELVSSn, and the N-th common voltage offset ELVSSn may correspond to a lowest voltage from among the first through N-th common voltage offsets ELVSS1 through ELVSSn.

In one embodiment, the common voltage selector 260 may directly receive the target luminance TL, and may select a common voltage offset ELVSSk corresponding to the reference gamma set GSETk among the first through N-th common voltage offsets ELVSS1 through ELVSSn based on the target luminance TL. The selected common voltage offset ELVSSk and the reference gamma set GSETk (and the selected initialization voltage VINTk) may be selected at the same time. In one embodiment, the common voltage selector 260 may receive information of the reference gamma set GSETk from the gamma set selector 220, and may select the selected common voltage offset ELVSSk corresponding to the reference gamma set GSETk.

The common voltage selector 260 may select a K-th common voltage offset ELVSSk to the common voltage, when the target luminance TL corresponds to the K-th reference luminance. The K-th common voltage offset ELVSSk may correspond to the K-th reference luminance and the K-th gamma set GSETk. The initialization voltage may be provided the determiner 280.

The common voltage selector 260 may select a J-th common voltage offset ELVSSj corresponding to the J-th reference luminance, and a (J-1)-th common voltage offset ELVSSj-1 corresponding to the (J-1)-th reference luminance, when the target luminance TL is between the (J-1)-th reference luminance and the J-th reference luminance. The J-th common voltage offset ELVSSj and the (J-1)-th common voltage offset ELVSSj-1 may be provided to the determiner 280.

The determiner 280 may determine a target initialization voltage TVINT provided to the display panel based on the target luminance TL and the initialization voltage VINTk. The determiner 280 may determine a target common voltage TELVSS provided to the display panel based on the target luminance TL and the common voltage ELVSSk. In one embodiment, the target initialization voltage TVINT and the target common voltage TELVSS may be generated at a power supply. The power supply may be included in the luminance controller 200.

The determiner 280 may determine the initialization voltage VINTk as the target initialization voltage TVINT and determine the common voltage ELVSSk as the target common voltage TELVSS, when the target luminance TL corresponds to the K-th reference luminance.

The determiner 280 may linearly (or otherwise) interpolate between the J-th initialization voltage offset VINTj and the (J-1)-th initialization voltage offset VINTj-1, that are received from the initialization voltage selector 240, to determine the target initialization voltage TVINT when the target luminance TL is between the (J-1)-th reference luminance and the J-th reference luminance. In addition, the determiner 280 may linearly (or otherwise) interpolate between the J-th common voltage offset ELVSSj and the (J-1)-th common voltage offset ELVSSj-1, that are received from the common voltage selector 260, to determine the target common voltage TELVSS when the target luminance TL is between the (J-1)-th reference luminance and the J-th reference luminance.

The target initialization voltage TVINT and the target common voltage TELVSS may be controlled by the predetermined offsets according to the luminance change. In addition, the target initialization voltage TVINT and the target common voltage TELVSS may be determined based on the gamma set selection for the dimming control. Thus, a voltage difference between the target initialization voltage TVINT and the target common voltage TELVSS may be reduced or minimized when BCB operation is performed, so that light emission delay caused by the BCB operation may be reduced or minimized. Particularly, a voltage for BCB operation may be moved closer to a threshold voltage of the organic light emitting diode when a low driving current display such as a low luminance display and/or a low grayscale display is performed, so that light emission delay may be reduced.

As described above, the luminance controller 200 may control the target initialization voltage TVINT and the target common voltage TELVSS, that are commonly applied to the display panel, based on the target luminance TL such that light emission delay may be improved without significant change in the optical characteristics of the display. Further, color shift may be eliminated or reduced in the low luminance (low grayscale) range.

FIG. 5 is a diagram illustrating an example in which a gamma set, an initialization voltage offset, and a common voltage offset are set in the luminance controller of FIG. 4.

Referring to FIGS. 4 and 5, the luminance controller 200 may include a plurality of gamma sets, a plurality of initialization voltage offsets, and a plurality of common voltage offsets.

The display luminance range may be divided into a plurality of reference luminance levels DBL. For example, as illustrated in FIG. 5, the reference luminance may be divided into 7 levels. A first level LEVEL1 may be a minimum luminance level and a seventh level LEVEL7 may be a maximum luminance level. The first though seventh levels LEVEL1 through LEVEL7 may define first through seventh reference luminance points DBV1 through DBV7, respectively. In one embodiment, the reference luminance points DBV1 through DBV7 may be represented by 8 bit data. Thus, the luminance of the display device may be divided by 8 bit luminance levels, i.e., 256 luminance levels.

The gamma set selector 220 may include the plurality of gamma sets (e.g., indicated in FIG. 5 as GAMMA SET1 through GAMMA SET7) corresponding to the reference luminance points DBV1 through DBV7. For example, the gamma set selector 220 may include a register to store a plurality of register values respectively corresponding to the first through seventh gamma sets GAMMA SET1 through GAMMA SET7. Accordingly, a specific gamma set may be selected by comparing a target luminance with the reference luminance points DBV1 through DBV7 when luminance dimming is performed.

Similarly, a plurality of initialization voltage offsets VINT_OFFSET may be set to respectively correspond to the reference luminance points DBV1 through DBV7, and a plurality of common voltage offsets ELVSS_OFFSET may be set to respectively correspond to the reference luminance points DBV1 through DBV7. Namely, the initialization voltage offsets VINT_OFFSET, the common voltage offsets ELVSS_OFFSET, and the gamma sets GAMMA SET may be set to correspond to the same reference luminance points DBV1 through DBV7, respectively. Thus, the gamma set, the initialization voltage offset, and the common voltage offset may be concurrently controlled according to the display luminance (or the target luminance).

Figure 6:
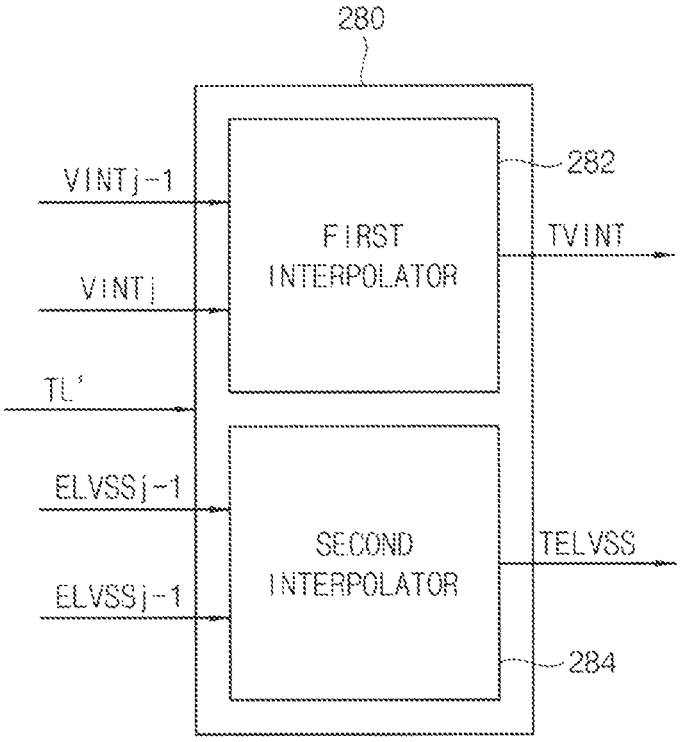
FIG. 6 is a block diagram illustrating an example of a determiner included in the luminance controller of FIG. 4.

FIG. 6 is a block diagram illustrating an example of a determiner included in the luminance controller of FIG. 4.

Referring to FIG. 6, the determiner 280 may include a first interpolator 282 and a second interpolator 284.

When a target luminance TL' is between a (J-1)-th reference luminance and a J-th reference luminance, the determiner 280 may receive a (J-1)-th initialization voltage offset VINTj-1 and a J-th initialization voltage offset VINTj from the initialization voltage selector 240, and may receive a (J-1)-th common voltage offset ELVSSj-1 and a J-th common voltage offset ELVSSj from the common voltage selector 260.

The first interpolator 282 may perform a linear interpolation between the J-th initialization voltage offset VINTj and the (J-1)-th initialization voltage offset VINTj-1, to determine a target initialization voltage TVINT. Thus, the target initialization voltage TVINT corresponding to the target luminance TL' may be determined even when the target luminance TL' does not exactly correspond to any particular reference luminance.

The second interpolator 284 may perform a linear interpolation between the J-th common voltage offset ELVSSj and the (J-1)-th common voltage offset ELVSSj-1, to determine a target common voltage TELVSS. Thus, the target common voltage TELVSS corresponding to the target luminance TL' may be determined even when it does not exactly correspond to any particular reference luminance.

Figure 7A:
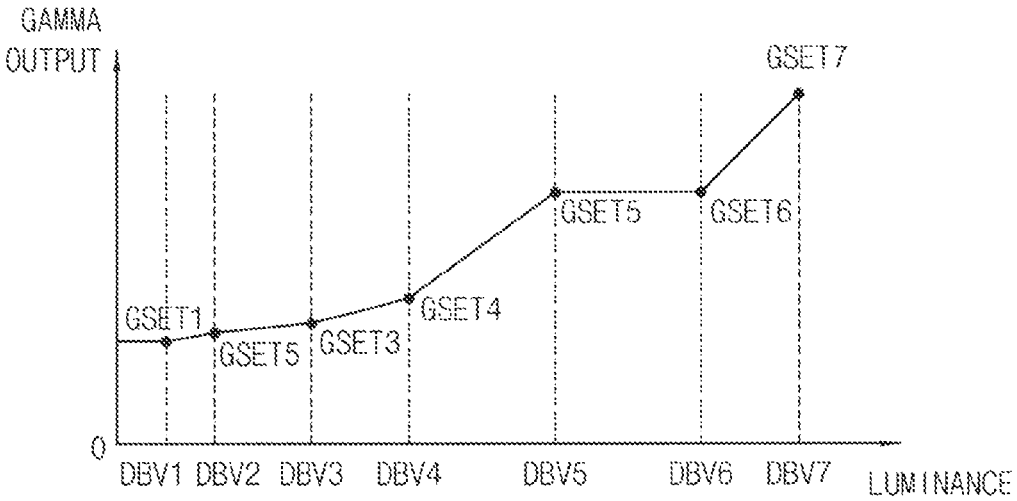
FIG. 7A is a diagram illustrating an example of a plurality of gamma sets in the luminance controller of FIG. 4.
Figure 7B:
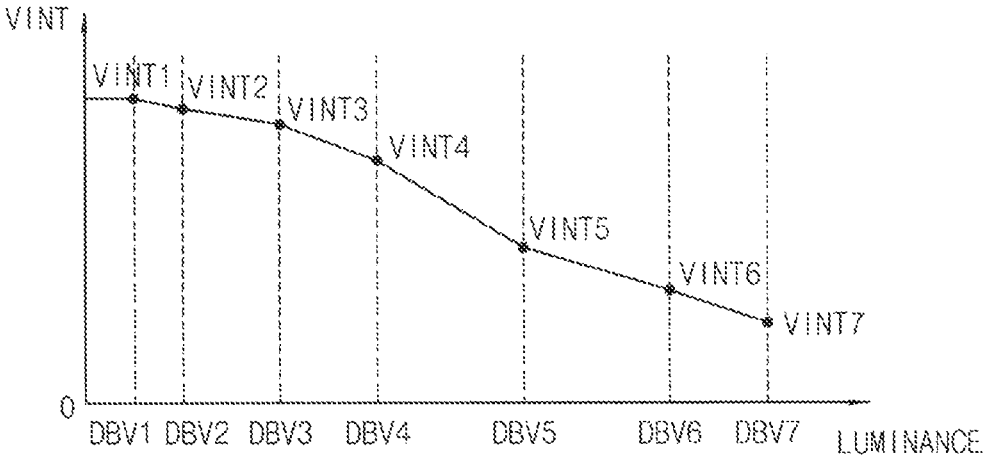
FIG. 7B is a diagram illustrating an example of a plurality of initialization voltages in the luminance controller of FIG. 4.
Figure 7C:
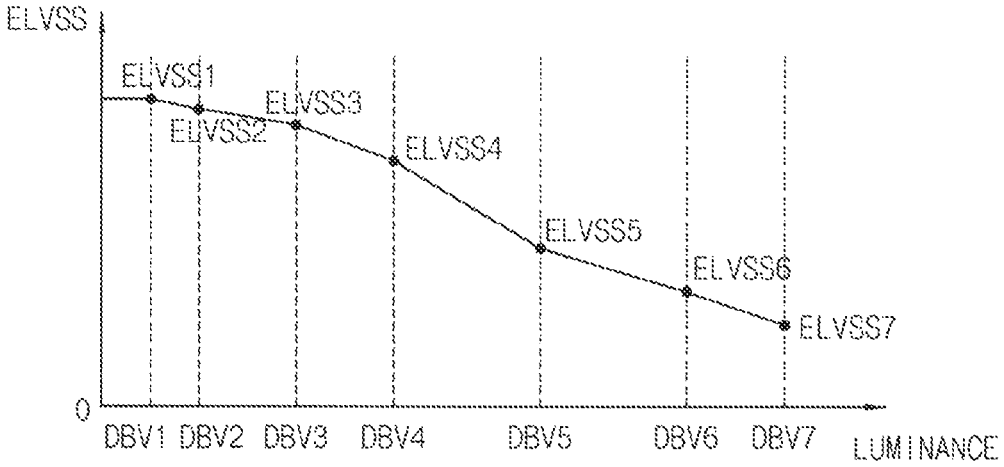
FIG. 7C is a diagram illustrating an example of a plurality of common voltages in the luminance controller of FIG. 4.

FIG. 7A is a diagram illustrating an example of a plurality of gamma sets in the luminance controller of FIG. 4. FIG. 7B is a diagram illustrating an example of a plurality of initialization voltages in the luminance controller of FIG. 4. FIG. 7C is a diagram illustrating an example of a plurality of common voltages in the luminance controller of FIG. 4.

Referring to FIGS. 7A through 7C, a plurality of gamma sets GSET1 to GSET7, a plurality of voltages corresponding to initialization voltage offsets VINT1 to VINT7, and a plurality of voltages corresponding to common voltage offsets ELVSS1 to ELVSS7 may be respectively set to correspond to a plurality of reference luminance points DBV1 to DBV7.

In one embodiment, display luminance may be divided into 256 levels, and the luminance controller 200 may set 7 reference luminance points DBV1 to DBV7. First to seventh reference luminance points DBV1 to DBV7 may be set in ascending order of luminance. For example, the first reference luminance point DBV1 may correspond about 100 nit and the seventh reference luminance point DBV7 may correspond to a maximum luminance of an organic light emitting display device (e.g., about 350 nit).

As illustrated in FIG. 7A, the first to seventh gamma sets GSET1 to GSET7 may correspond to the first to seventh reference luminance points DBV1 to DBV7, respectively. When the target luminance does not exactly correspond to any of the target gamma sets GSET1 to GSET7, the target gamma set may be determined by interpolating 2 adjacent gamma sets that respectively correspond to 2 reference luminance points each adjacent to the target luminance.

As illustrated in FIG. 7B, the voltages respectively corresponding to the first to seventh initialization voltage offsets VINT1 to VINT7 may correspond to the first to seventh reference luminance points DBV1 to DBV7, respectively. Here, the first initialization voltage offset VINT1 may correspond to the highest voltage among the first through seventh initialization voltage offsets VINT1 to VINT7, and the seventh initialization voltage offset VINT7 may correspond to the lowest voltage among the first through seventh initialization voltage offsets VINT1 to VINT7. In one embodiment, when the target luminance does not exactly correspond to any of the target gamma sets GSET1 to GSET7, the target initialization voltage may be determined by interpolating 2 adjacent initialization voltage offsets that respectively correspond to the 2 reference luminance points each adjacent to the target luminance. Here, as the target luminance increases, the target initialization voltage may decrease.

As illustrated in FIG. 7C, the voltages respectively corresponding to the first to seventh common voltage offsets ELVSS1 to ELVSS7 may correspond to the first to seventh reference luminance points DBV1 to DBV7, respectively.

Here, the first common voltage offset ELVSS1 may correspond to the highest voltage among the first through seventh common voltage offsets ELVSS1 to ELVSS7, and the seventh common voltage offset ELVSS7 may correspond to the lowest voltage among the first through seventh common voltage offsets ELVSS1 to ELVSS7. In one embodiment, when the target luminance does not exactly correspond to any of the target gamma sets GSET1 to GSET7, the target common voltage may be determined by interpolating 2 adjacent initialization voltage offsets that respectively correspond to the 2 reference luminance points each adjacent to the target luminance. As the target luminance increase, the target common voltage may decrease.

Accordingly, the luminance controller 200 may control the target initialization voltage and the target common voltage, using voltage offsets (i.e., the initialization voltage offsets and the common voltage offsets) determined according to the target luminance change. Thus, a voltage difference between the target initialization voltage and the target common voltage may be reduced or minimized when BCB operation is performed, so that light emission delay caused by BCB operation may be reduced or minimized. Particularly, a voltage for BCB operation may be moved closer to a threshold voltage of the organic light emitting diode when a low driving current display such as a low luminance display and/or a low grayscale display is used, so that light emission delay may be reduced.

As described above, the luminance controller 200 may control the target initialization voltage and the target common voltage, that are commonly applied to the display panel, based on the change of the target luminance such that the light emission delay may be improved without a change of optical characteristics. Further, a color shift may be eliminated or reduced in the low luminance (low grayscale) range.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein. Various features of the above described and other embodiments can thus be mixed and matched in any manner, to produce further embodiments consistent with the invention.

What is claimed is:

1. A luminance controller comprising:

a gamma set selector configured to select a reference gamma set from among a first gamma set through an N-th gamma set respectively corresponding to a first reference luminance through an N-th reference luminance, based on a target luminance of a display panel, wherein the first through N-th reference luminances are set in ascending order of luminance;

an initialization voltage selector configured to select an initialization voltage corresponding to the reference gamma set, the initialization voltage being selected from among first through N-th initialization voltage offsets respectively corresponding to the first through N-th gamma sets;

a common voltage selector configured to select a common voltage corresponding to the reference gamma set, the common voltage being selected from among first through N-th common voltage offsets respectively corresponding to the first through N-th gamma sets; and a determiner configured to determine a target initialization voltage to be provided to the display panel, the target initialization voltage determined based on the target luminance and the initialization voltage, and to determine a target common voltage provided to the display panel, the target common voltage determined based on the target luminance and the common voltage, wherein N is an integer greater than 1, and wherein the initialization voltage selector selects a J-th initialization voltage offset and a (J−1)th initialization voltage offset to provide to the determiner when the target luminance is between a (J−1)-th reference luminance and a J-th reference luminance, wherein the common voltage selector is configured to select a J-th common voltage offset and a (J−1)-th common voltage offset to provide to the determiner when the target luminance is between the (J−1)-th reference luminance and the J-th reference luminance, and wherein J is an integer greater than or equal to 2 and less than or equal to N.

2. The luminance controller of claim 1, wherein the target initialization voltage corresponds to an anode initialization voltage of an organic light emitting diode in the display panel.

3. The luminance controller of claim 2, wherein the target common voltage corresponds to a voltage to be applied to a cathode of the organic light emitting diode.

4. The luminance controller of claim 1, wherein the first initialization voltage offset corresponds to a highest voltage from among the first through N-th initialization voltage offsets, and the N-th initialization voltage offset corresponds to a lowest voltage from among the first through N-th initialization voltage offsets.

5. The luminance controller of claim 1, wherein the first common voltage offset corresponds to a highest voltage from among the first through N-th common voltage offsets, and the N-th common voltage offset corresponds to a lowest voltage from among the first through N-th common voltage offsets.

6. The luminance controller of claim 1, wherein the initialization voltage selector is configured to select a K-th initialization voltage offset as the initialization voltage when the gamma set selector selects a K-th gamma set as the reference gamma set, wherein the common voltage selector is configured to select a K-th common voltage offset as the common voltage when the gamma set selector selects the K-th gamma set as the reference gamma set, and wherein K is an integer greater than or equal to 1 and less than or equal to N.

7. The luminance controller of claim 6, wherein the determiner is configured to determine the initialization voltage as the target initialization voltage and to determine the common voltage as the target common voltage, when the target luminance corresponds to a K-th reference luminance.

8. The luminance controller of claim 1, wherein the determiner comprises:

a first interpolator configured to perform an interpolation between the J-th initialization voltage offset and the (J−1)-th initialization voltage offset to determine the target initialization voltage; and a second interpolator configured to perform an interpolation between the J-th common voltage offset and the (J−1)-th common voltage offset to determine the target common voltage.

9. The luminance controller of claim 1, wherein the gamma set selector comprises:

a register configured to store a plurality of register values respectively corresponding to the first through N-th gamma sets.

10. The luminance controller of claim 1, wherein the determiner is configured to directly receive the initialization voltage corresponding to the reference gamma set from the initialization voltage selector, and to directly receive the common voltage corresponding to the reference gamma set from the common voltage selector.

11. An organic light emitting display device comprising:

a display panel including a plurality of pixels each having an organic light emitting diode;

a luminance controller configured to select a reference gamma set based on a target luminance of the display panel, and to determine a target initialization voltage and a target common voltage based on the target luminance and the reference gamma set;

a gamma voltage generator configured to determine a target gamma set by comparing a reference luminance corresponding to the reference gamma set with the target luminance, and to generate a plurality of gamma voltages having voltage values within the target gamma set, and to perform an interpolation between a J-th gamma set and a (J−1)-th gamma set when the target luminance is between a (J−1)-th reference luminance and a J-th reference luminance;

a display panel driver configured to drive the display panel based on the gamma voltages; and a power supply configured to provide the target initialization voltage, the target common voltage, and a driving voltage to the display panel based on a control of the luminance controller, wherein J is an integer greater than or equal to 2 and less than or equal to N.

12. The device of claim 11, wherein the luminance controller comprises:

a gamma set selector configured to select the reference gamma set from among a first gamma set through an N-th gamma set respectively corresponding to a first reference luminance through an N-th reference luminance based on the target luminance, the first through N-th reference luminances being respectively in ascending order of luminance;

an initialization voltage selector configured to select an initialization voltage corresponding to the reference gamma set, from among a first through an N-th initialization voltage offset respectively corresponding to the first through N-th gamma sets;

a common voltage selector configured to select a common voltage corresponding to the reference gamma set, from among a first through an N-th common voltage offset respectively corresponding to the first through N-th gamma sets; and a determiner configured to determine the target initialization voltage based on the target luminance and the initialization voltage, and to determine the target common voltage based on the target luminance and the common voltage, where N is an integer greater than 1.

13. The device of claim 12, wherein the target initialization voltage corresponds to an anode initialization voltage of the organic light emitting diode.

14. The device of claim 12, wherein the target common voltage corresponds to a voltage to be applied to a cathode of the organic light emitting diode.

15. The device of claim 12, wherein the first initialization voltage offset corresponds to a highest voltage from among the first through N-th initialization voltage offsets, and the N-th initialization voltage offset corresponds to a lowest voltage from among the first through N-th initialization voltage offsets.

16. The device of claim 15, wherein the first common voltage offset corresponds to a highest voltage from among the first through N-th common voltage offsets, and the N-th common voltage offset corresponds to a lowest voltage from among the first through N-th common voltage offsets.

17. The device of claim 12, wherein the initialization voltage selector is configured to select a K-th initialization voltage offset as the initialization voltage when the gamma set selector selects a K-th gamma set as the reference gamma set, wherein the common voltage selector is configured to select a K-th common voltage offset as the common voltage when the gamma set selector selects the K-th gamma set as the reference gamma set, and wherein K is an integer greater than or equal to 1 and less than or equal to N.

18. The device of claim 12, wherein the determiner comprises:

a first interpolator configured to perform an interpolation between the J-th initialization voltage offset and the (J−1)-th initialization voltage offset, to determine the target initialization voltage when the initialization voltage selector selects a J-th initialization voltage offset and a (J−1)-th initialization voltage offset; and a second interpolator configured to perform an interpolation between the J-th common voltage offset and the (J−1)-th common voltage offset to determine the target common voltage when the initialization voltage selector selects the J-th initialization voltage offset and the (J−1)-th initialization voltage offset.

19. The device of claim 11, wherein the display panel driver comprises:

a scan driver configured to provide a scan signal to the display panel;

an emission driver configured to provide an emission control signal to the display panel;

a data driver configured to provide a data voltage to the display panel, the data voltage generated based on the gamma voltages; and a controller configured to control the scan driver, the emission driver, and the data driver.

* * * * *